US011217931B2

(12) United States Patent
Ye et al.

(10) Patent No.: US 11,217,931 B2
(45) Date of Patent: Jan. 4, 2022

(54) SOCKET OF OPTICAL CONTROLLER AND WATERPROOF SEALING SOCKET OF OPTICAL CONTROLLER

(71) Applicant: ZHEJIANG QICHENG ELECTRICAL EQUIPMENT CO., LTD., Zhejiang (CN)

(72) Inventors: Xuanfeng Ye, Zhejiang (CN); Hanxing Lan, Zhejiang (CN)

(73) Assignee: Zhejiang Qicheng Electrical Co., Ltd., Wenzhou (CN)

( * ) Notice: Subject to any disclaimer, the term of this patent is extended or adjusted under 35 U.S.C. 154(b) by 0 days.

(21) Appl. No.: 17/010,552

(22) Filed: Sep. 2, 2020

(65) Prior Publication Data

US 2020/0403354 A1 Dec. 24, 2020

Related U.S. Application Data

(63) Continuation of application No. 16/565,909, filed on Sep. 10, 2019, now Pat. No. 10,811,811.

(30) Foreign Application Priority Data

Sep. 11, 2018 (CN) ..... 201821482686.2
Sep. 11, 2018 (CN) ..... 201821483256.2

(51) Int. Cl.

| | |
|---|---|
| ***H01R 13/52*** | (2006.01) |
| ***H01R 13/10*** | (2006.01) |
| ***H01R 13/629*** | (2006.01) |
| ***H01R 13/40*** | (2006.01) |

(52) U.S. Cl.
CPC ..... *H01R 13/5202* (2013.01); *H01R 13/10* (2013.01); *H01R 13/40* (2013.01); *H01R 13/629* (2013.01)

(58) Field of Classification Search
CPC .. H01R 13/5202; H01R 13/625; H01R 13/10; H01R 13/629; H01R 13/40; H01R 33/46; H01R 33/7685
USPC ..... 439/559, 548, 556, 332, 335, 336, 337
See application file for complete search history.

(56) References Cited

U.S. PATENT DOCUMENTS

| | | | | |
|---|---|---|---|---|
| 10,811,811 | B2 * | 10/2020 | Ye | H01R 13/5202 |
| 2011/0230086 | A1 * | 9/2011 | Fujiwara | H01R 13/6584 439/559 |
| 2020/0083635 | A1 * | 3/2020 | Ye | H01R 13/5202 |

* cited by examiner

*Primary Examiner* — Gary F Paumen
(74) *Attorney, Agent, or Firm* — Greenberg Traurig, LLP

(57) ABSTRACT

The present disclosure relates to a socket of an optical controller, including: a base having an electrical plughole and a pin accommodation groove; a mounting seat having a wire trough and a pin mounting groove; a metal pin, arranged in a cavity formed by the pin accommodation groove and the pin mounting groove; a contact piece, connected with an external wire, and comprising a wiring pin, a positioning pin and a contact surface that has an arc shape matching with that of the base; a groove, arranged at a joint corner of the wiring pin and the positioning pin with the contact surface; the wiring pin and the positioning pin are arranged on both sides of the contact surface; and the wiring pin and the positioning pin are bent 90-degree on an inner side of the groove. The present disclosure also discloses a water-proof sealing socket of an optical controller.

2 Claims, 7 Drawing Sheets

SOCKET OF OPTICAL CONTROLLER AND WATERPROOF SEALING SOCKET OF OPTICAL CONTROLLER

CROSS REFERENCE TO RELATED APPLICATIONS

The present disclosure is continuation of and claims priority of U.S. patent application Ser. No. 16/565,909, filed Sep. 10, 2019, which claims priority to Chinese patent applications 201821483256.2 and 201821482686.2 filed on Sep. 11, 2018, all contents of which are incorporated herein in entirety by reference.

TECHNICAL FIELD

The present disclosure relates to a socket of an optical controller and a waterproof sealing socket of an optical controller.

BACKGROUND

Light controllers are used for controlling light switches by sensing the change in a light source, and are usually used in automatic power control devices which need to work at night, such as street lamps, illumination lamps, and advertisement lamp boxes, etc. During installation of a common light controller, the position of corresponding light sources or the environment needs to be taken into account, so that the light controller functions effectively. In order to cooperate with a light controller and make the controller safer, a socket of an optical controller is often adopted to supply power for the light controller. And the contact surface of a contact piece of existing sockets of an optical controller has a gold-plated layer, so as to improve the contact performance of the socket of an optical controller. Because a single socket of an optical controller has four contact surfaces, which have a large gross relative area and consume a great amount of gold, leading to a high level of production cost for the socket of an optical controller, hindering its wide application.

In addition, generally, waterproof sealing performance in an open working environment needs to be taken into consideration during installation of a common light controller. The water-proof spacer of an existing socket of an optical controller has a large area, with one side attached to a base and the other side attached to a mounting surface; the socket relies on a central hole and a central cylinder of the waterproof spacer to achieving positioning, wherein the attachment surface tends to be uneven, resulting in undesirable compression, there is a potential risk of water leakage, leading to poor waterproof effect. And it only takes circular edge areas of about 2-3 mm wide along the outer edge of the spacer and of the base to be compressed and attached to achieve waterproof property, and the design of a large area of the water-proof spacer causes waste of the raw material.

SUMMARY

The present disclosure provides a socket of an optical controller, which has a simple structure, a relatively small gross gold-plated area on its contact surface, as well as low production cost.

The socket of an optical controller of the present disclosure includes a base and a mounting seat interconnected, both sides of the base are respectively provided with an electrical plughole and a pin accommodation groove intercommunicated. Both sides of the mounting seat are respectively provided with a wire trough and a pin mounting groove intercommunicated. A metal pin is arranged in a cavity formed by the pin accommodation groove and the pin mounting groove facing towards each other. The wire trough is connected with an external wire. A side surface of the electrical plughole of the base is provided with a contact piece which is connected with an external wire, the contact piece includes a wiring pin, a positioning pin and a contact surface which are structurally integrated. The contact surface has an arc shape matched with that of the base, and the wiring pin and the positioning pin are respectively provided on both sides of the contact surface. A groove is arranged at a joint corner of the wiring pin and the positioning pin with the contact surface and concaves towards the contact surface. And the wiring pin and the positioning pin are bent 90-degree on an inner side of the groove.

Both sides of the wiring pin are bent to form a positioning block, and a lower portion of the wiring pin is bent to form a wire clamping groove.

A side portion of the positioning pin is bent to form an elastic positioning piece.

Through the above specific design of the present disclosure, the area between the bending position and the arc edge is reduced, and the bending at the arc edge can be realized without causing warping deformation of the arc plane due to bending, thus reducing the area of the arc plane. The socket of an optical controller has the advantages of a relatively small gross gold-plated area on its contact surface, a simple structure, and low production cost, and the production cost is estimated to be reduced by more than 30%.

In addition, the present disclosure further provides a waterproof sealing socket of an optical controller, which has a simple structure, good waterproof effect and low production cost, and saves raw materials. The waterproof sealing socket of an optical controller of the present disclosure includes a base and a mounting seat interconnected. Both sides of the base are respectively provided with an electrical plughole and a pin accommodation groove intercommunicated. Both sides of the mounting seat are respectively provided with a wire trough and a pin mounting groove intercommunicated. A metal pin is arranged in a cavity formed by the pin accommodation groove and the pin mounting groove facing towards each other. A contact piece is arranged on a front side of the base and connected with an external wire, and a first groove is arranged on a back side of the base and near a peripheral outline of the base. A central positioning flange is arranged on the water-proof sealing ring and fixed in the first groove of the base.

The first groove is a circular and continuous groove.

A segmented second groove is arranged on an inner side of the first groove of the base, and a side positioning flange is arranged on an inner side of the central positioning flange on the waterproof sealing ring and fixed in the second groove.

Through the above specific design, in the present disclosure, the waterproof sealing ring has a fixed position to prevent offset, and a smooth fitting surface to facilitate desirable compression, reduces redundant spacer area by about 70% compared with the prior art, and has the advantages of simple structure, good waterproof and raw material conservation effect, and low production cost.

BRIEF DESCRIPTION OF THE DRAWINGS

One or more embodiments are illustrated by way of example, and not by limitation, in the figures of the accompanying drawings, wherein elements having the same reference numeral designations represent like elements throughout. The drawings are not to scale, unless otherwise disclosed. Detailed contents of the present disclosure will be illustrated in conjunction with the drawings and embodiments.

DETAILED DESCRIPTION

Figure 1:
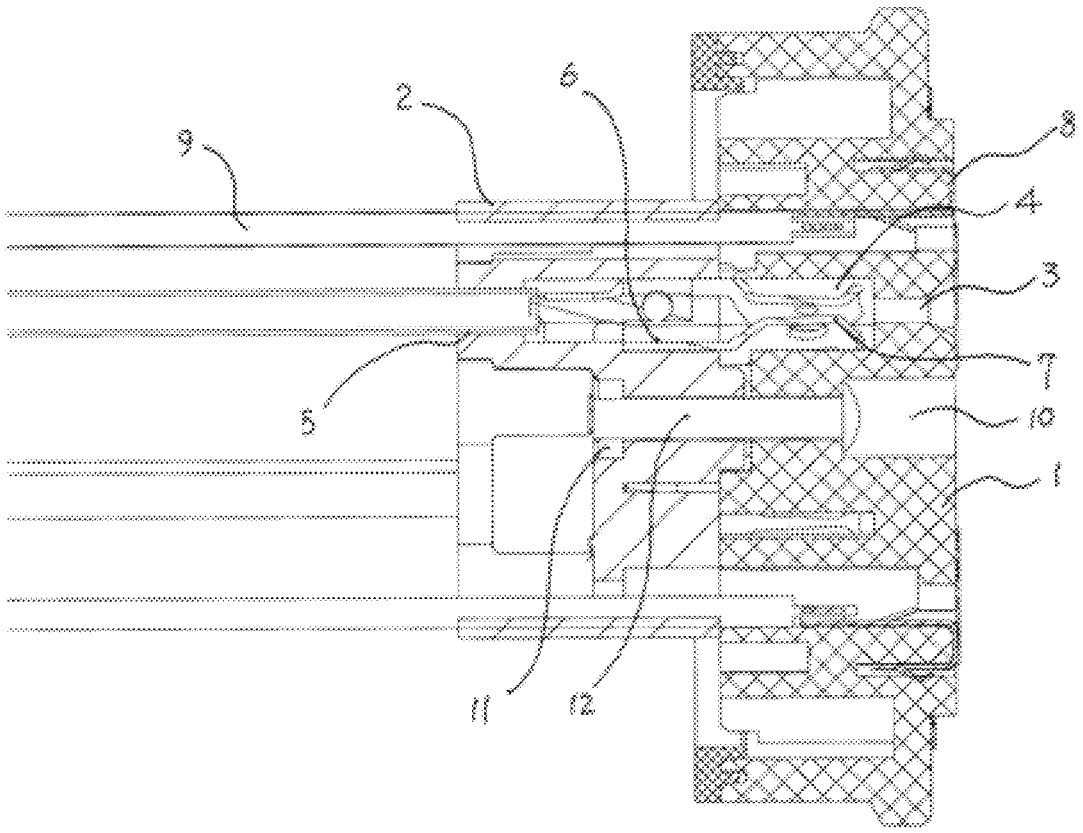
FIG. 1 is a structural view of a socket of an optical controller of the present disclosure.
Figure 2:
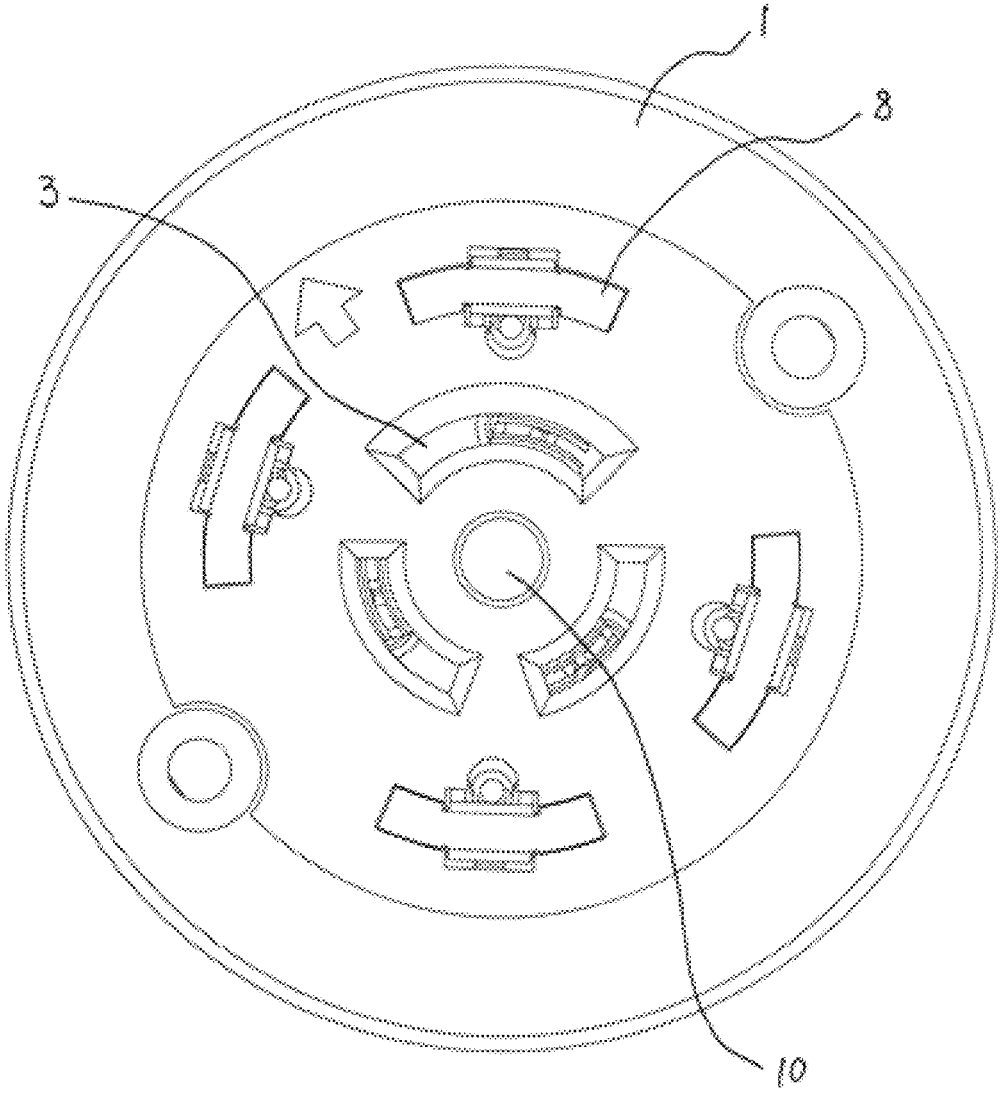
FIG. 2 is a right view of FIG. 1.
Figure 3:
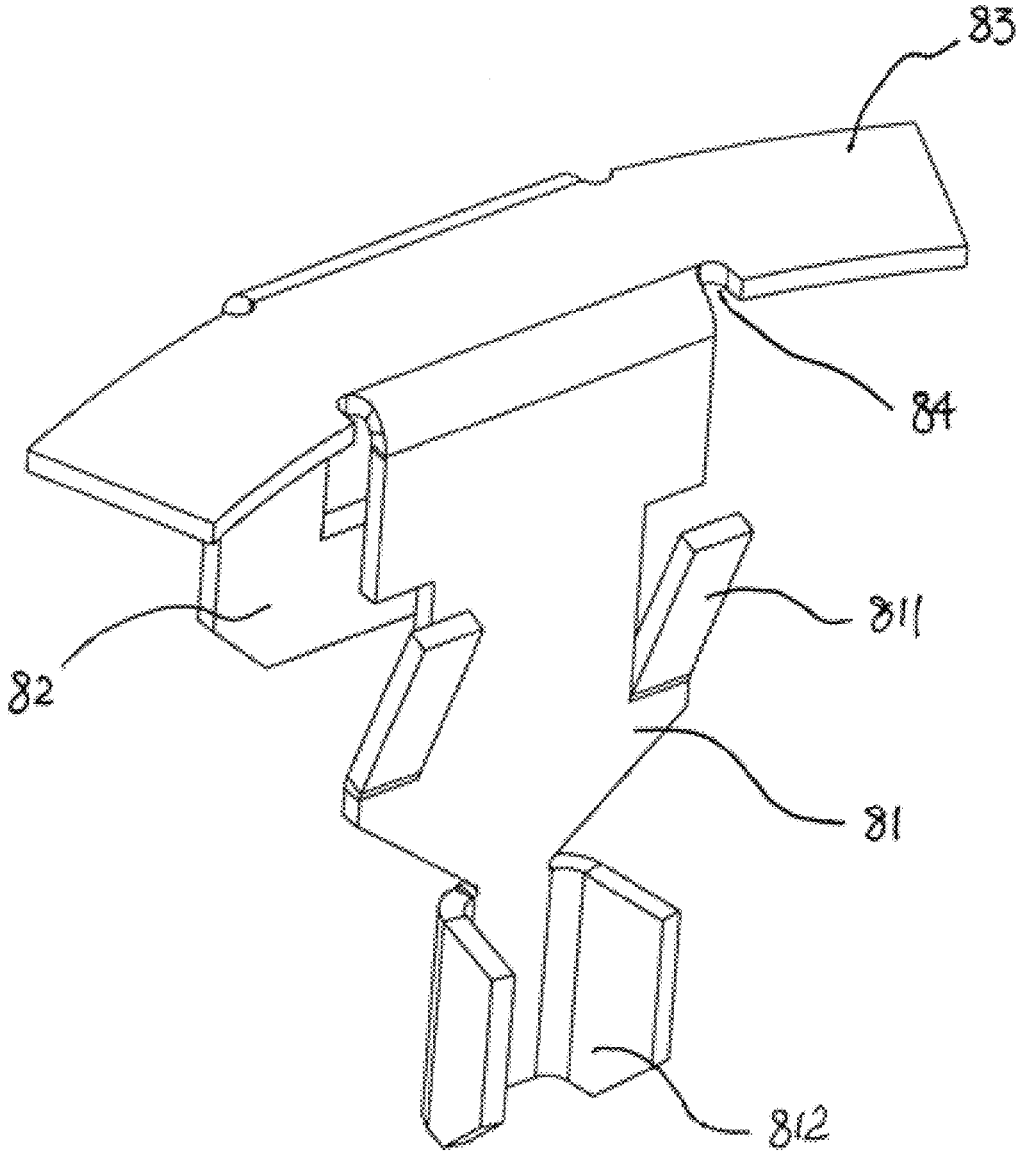
FIG. 3 is a three-dimensional structural view of a contact piece viewed from one side of a socket of an optical controller of the present disclosure.
Figure 4:
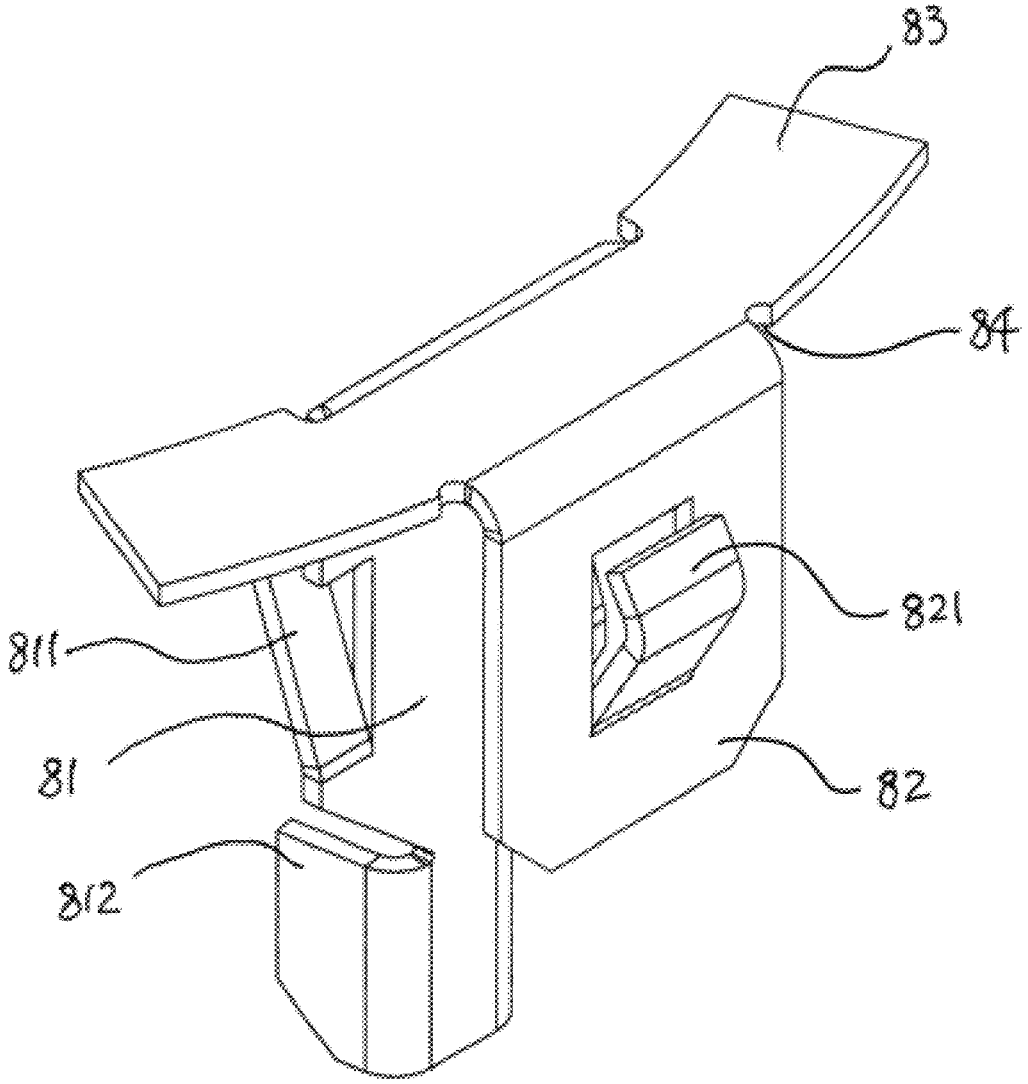
FIG. 4 is a three-dimensional structural view of a contact piece viewed from the other side of a socket of an optical controller of the present disclosure.

As shown in FIGS. 1-3, in an embodiment, the present disclosure includes a base 1 and a mounting seat 2 interconnected, both sides of the base 1 are respectively provided with an electrical plughole 3 and a pin accommodation groove 4 intercommunicated. Both sides of the mounting seat 2 are respectively provided with a wire trough 5 and a pin mounting groove 6 intercommunicated. A metal pin 7 is arranged in a cavity formed by the pin accommodation groove 4 and the pin mounting groove 6 facing towards each other. The wire trough 5 is connected with an external wire. A side surface of the electrical plughole 3 of the base 1 is provided with a contact piece 8 which is connected with an external wire 9. The contact piece 8 includes a wiring pin 81, a positioning pin 82 and a contact surface 83 which are integrally formed. The contact surface 83 has an arc shape matching with that of the base 1, and the wiring pin 81 and the positioning pin 82 are respectively arranged on both sides of the contact surface 83. A groove 84 is arranged at a joint corner of the wiring pin 81 and the positioning pin 82 with the contact surface 83 and concaves towards the contact surface 83. And the wiring pin 81 and the positioning pin 82 are bent 90-degree on an inner side of the groove 84. The groove 84 is designed such that the contact surface 83 is gold-plated on a relatively smaller area after bending of the wiring pin 81 and the positioning pin 82, thus reducing production cost; and the design of the groove 84 also facilitates shaping of the arc contact surface 83. Both sides of the wiring pin 81 are bent to form a positioning block 811, and a lower portion of the wiring pin 81 is bent to form a wire clamping groove 812. A side portion of the positioning pin 82 is bent to form an elastic positioning piece 821. The wire clamping groove 812 clamps and secures a connection wire 9, which is connected with an lower end of the wiring pin 81 in many ways, such as spot-welding, covered wire-crimping, quick plug-in, not limited to the wire clamping groove. The positioning block 811 and the elastic positioning piece 821 are designed such that the contact piece 8 is integrally positioned and installed in the base 1. The base 1 and the mounting seat 2 are further respectively provided with a first connection hole 10 and a second connection hole 11 for a rivet 12 to pass through to connect the base 1 and the mounting seat 2. Of course, the connection structure can be buckles, screws or bolts besides rivets. The above embodiments are merely description of preferential implementations of a socket of an optical controller of the present disclosure, rather than limitation to the concept and scope of the disclosure, all kinds of shape variations and improvements of the technical solutions of the present disclosure made by those skilled in the art, without departing from the solutions of the present disclosure, shall fall into the protection scope of the socket of an optical controller of the present disclosure.

Figure 5:
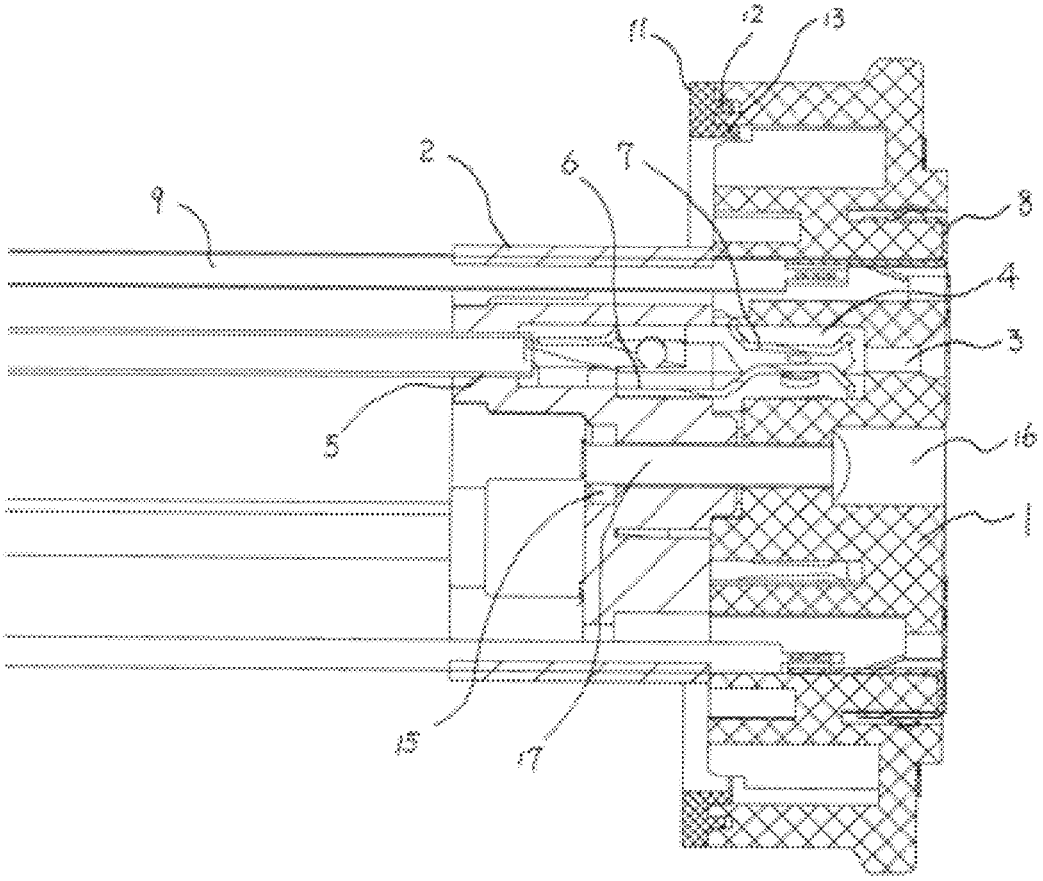
FIG. 5 is a structural view of a waterproof sealing socket of an optical controller of the present disclosure.
Figure 6:
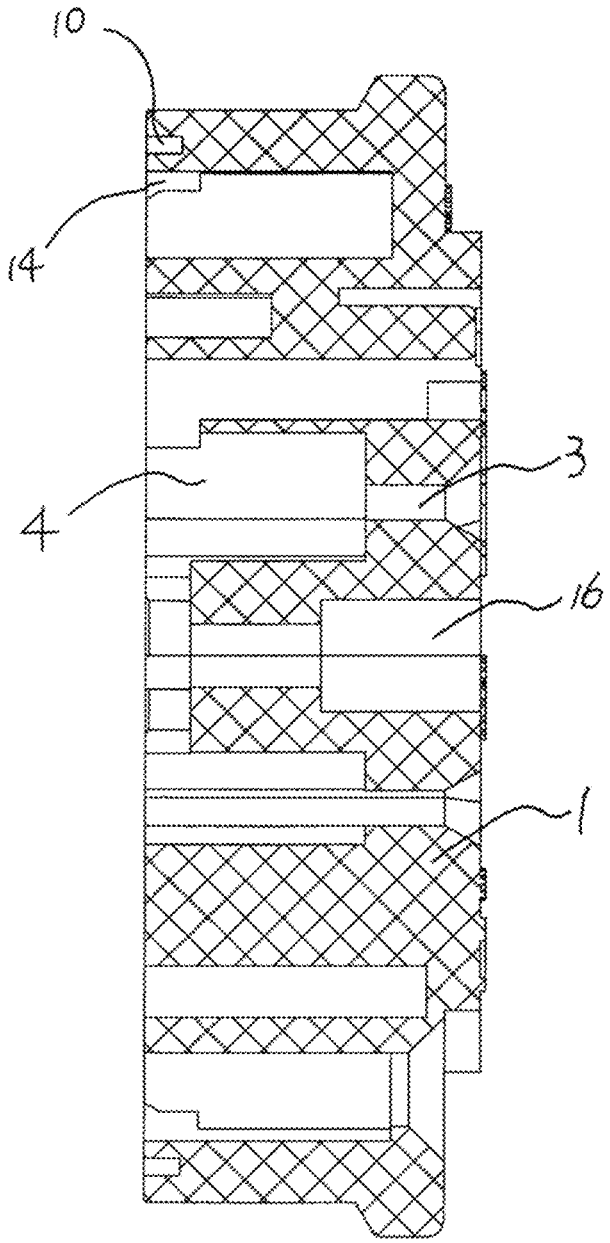
FIG. 6 is a structural view of a waterproof sealing socket of an optical controller without a waterproof sealing ring mounted on the base of the present disclosure.
Figure 7:
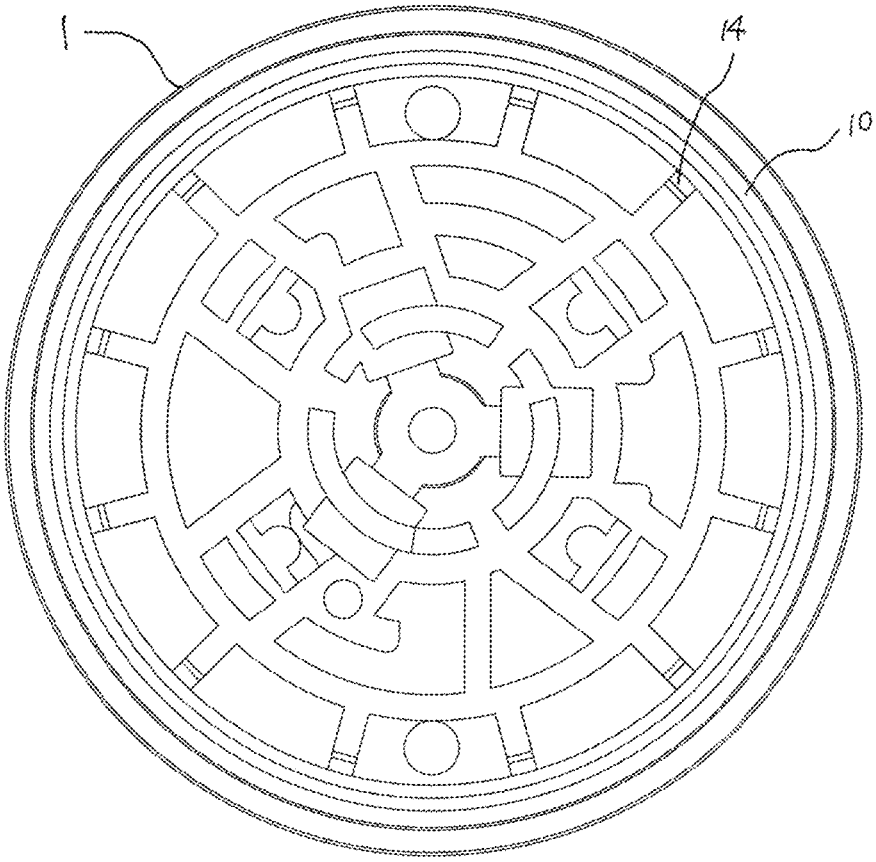
FIG. 7 is a left view of FIG. 6.

As shown in FIGS. 5-7, in another embodiment, the present disclosure includes a base 1 and a mounting seat 2 interconnected. Both sides of the base 1 are respectively provided with an electrical plughole 3 and a pin accommodation groove 4 intercommunicated. Both sides of the mounting seat 2 are respectively provided with a wire trough 5 and a pin mounting groove 6 intercommunicated. A metal pin 7 is arranged in a cavity formed by the pin accommodation groove 4 and the pin mounting groove 6 facing towards each other. A contact piece 8 is arranged on a front side of the base 1 and connected with an external wire 9, a first groove 10 is arranged on a back side of the base 1 and near a peripheral outline of the base 1. A central positioning flange 12 is arranged on the waterproof sealing ring and fixed in the first groove 10 of the base 1. The first groove 10 is a circular and continuous groove. A segmented second groove 14 is arranged on an inner side of the first groove 10 of the base 1, and a side positioning flange 13 is arranged on an inner side of the central positioning flange 12 on the waterproof sealing ring 11 and fixed in the second groove 14. Through positioning by the first groove 10 and the second groove 14, the waterproof sealing ring has a fixed position to prevent offset, and a smooth fitting surface to facilitate desirable compression, significantly improving waterproof sealing performance. The base land mounting seat 2 are further respectively provided with a first connection hole 16 and a second connection hole 15 for a rivet 17 to pass through to connect the base 1 and the mounting seat 2. Of course, the connection structure can be buckles, screws or bolts besides rivets. The above embodiments are merely description of preferential implementations of the waterproof sealing socket of an optical controller of the present disclosure, rather than limitation to the concept and scope of the disclosure, all kinds of shape variations and improvements of the technical solutions of the present disclosure made by those skilled in the art, without departing from the solutions of the present disclosure, shall fall into the protection scope of the waterproof sealing socket of an optical controller of the present disclosure.

What is claimed is:

1. A waterproof sealing socket of an optical controller, comprising:

a base having an electrical plughole and a pin accommodation groove interconnected and respectively arranged on both sides thereof;

a mounting seat connected with the base, and having a wire trough and a pin mounting groove intercommunicated and respectively arranged on both sides thereof;

a metal pin arranged in a cavity formed by the pin accommodation groove and the pin mounting groove facing towards each other;

a contact piece arranged on a front side of the base;

wherein the contact piece comprises:

a wiring pin configured to connect the contact piece to the external wire, and a positioning pin configured to integrally position the contact piece within the base;

a first groove arranged on a back side of the base;

a waterproof sealing ring having a central positioning flange arranged thereon and fixed in the first groove of the base;

wherein the first groove is a circular and continuous groove; and wherein the waterproof sealing socket of the optical controller further comprises:

a segmented second groove arranged on an inner side of the first groove of the base; and a side positioning flange arranged on an inner side of the central positioning flange on the waterproof sealing ring and fixed in the segmented second groove.

2. A method comprising:

producing waterproof sealing socket of an optical controller, comprising:

a base having an electrical plughole and a pin accommodation groove interconnected and respectively arranged on both sides thereof;

a mounting seat connected with the base and having a wire trough and a pin mounting groove intercommunicated and respectively arranged on both sides thereof;

a metal pin arranged in a cavity formed by the pin accommodation groove and the pin mounting groove facing towards each other;

a contact piece arranged on a front side of the base;

wherein the contact piece comprises:

a wiring pin configured to connect the contact piece to the external wire, and a positioning pin configured to integrally position the contact piece within the base;

a first groove arranged on a back side of the base;

a waterproof sealing ring having a central positioning flange arranged thereon and fixed in the first groove of the base;

wherein the first groove is a circular and continuous groove; and wherein the waterproof sealing socket of the optical controller further comprises:

a segmented second groove, arranged on an inner side of the first groove of the base; and a side positioning flange arranged on an inner side of the central positioning flange on the waterproof sealing ring and fixed in the segmented second groove.

* * * * *